United States Patent [19]

Thomas et al.

[11] Patent Number: 4,560,146

[45] Date of Patent: Dec. 24, 1985

[54] STRIPPER ASSEMBLY FOR REMOVING CARPET

[76] Inventors: Philip D. Thomas; Harvel W. Thomas, both of 10471 SW. 40 Ter., Miami, Fla. 33165

[21] Appl. No.: 623,517

[22] Filed: Jun. 22, 1984

Related U.S. Application Data

[63] Continuation-in-part of Ser. No. 505,298, Jun. 17, 1983, Pat. No. 4,533,118.

[51] Int. Cl.[4] ..... B66D 1/00

[52] U.S. Cl. ..... 254/202; 156/344; 254/208; 254/262

[58] Field of Search ..... 254/202, 199, 208, 213, 254/215, 204, 211, 217, 218, 219, 220, 222, 224, 227, 225, 262, 332; 156/344, 584, 247; 294/8.6

[56] References Cited

U.S. PATENT DOCUMENTS

| | | | |
|---|---|---|---|
| 336,571 | 2/1886 | Lawrence | 254/218 |
| 343,412 | 6/1886 | Willix | 254/211 |
| 882,873 | 3/1908 | Davis | 254/211 X |
| 888,689 | 5/1908 | Bradbury | 254/204 |
| 1,715,229 | 5/1929 | Frey | 254/227 |
| 2,876,583 | 3/1959 | Young | 294/8.6 |
| 3,929,555 | 12/1975 | Sanders | 254/362 |
| 4,129,326 | 12/1978 | Weck, III | 294/8.6 |
| 4,332,371 | 6/1982 | Bell et al. | 254/334 X |

FOREIGN PATENT DOCUMENTS

| | | | |
|---|---|---|---|
| 2024759 | 1/1980 | United Kingdom | 254/332 |

*Primary Examiner*—Stuart S. Levy
*Assistant Examiner*—Katherine Jaekel
*Attorney, Agent, or Firm*—John Cyril Malloy

[57] ABSTRACT

An assembly designed to strip carpet or like floor covering from the surface of a floor to which it is directly adhered as by adhesive or the like wherein a gripping jaw or like gripping structure is affixed to a carpet portion to be stripped and interconnected to an anchored driving assembly in the form of a winch and interconnecting cable. Activation of the winch causes a pulling force exerted on the gripping structure and steadily pulls and thereby strips the carpet from the surface to which it was adhered. One or more supplementary anchor assemblies may be secured between the driving assembly and the gripping structure so as to vary and determine the direction of pull of the gripping structure and carpet portion secured thereto relative to the driving assembly.

17 Claims, 18 Drawing Figures

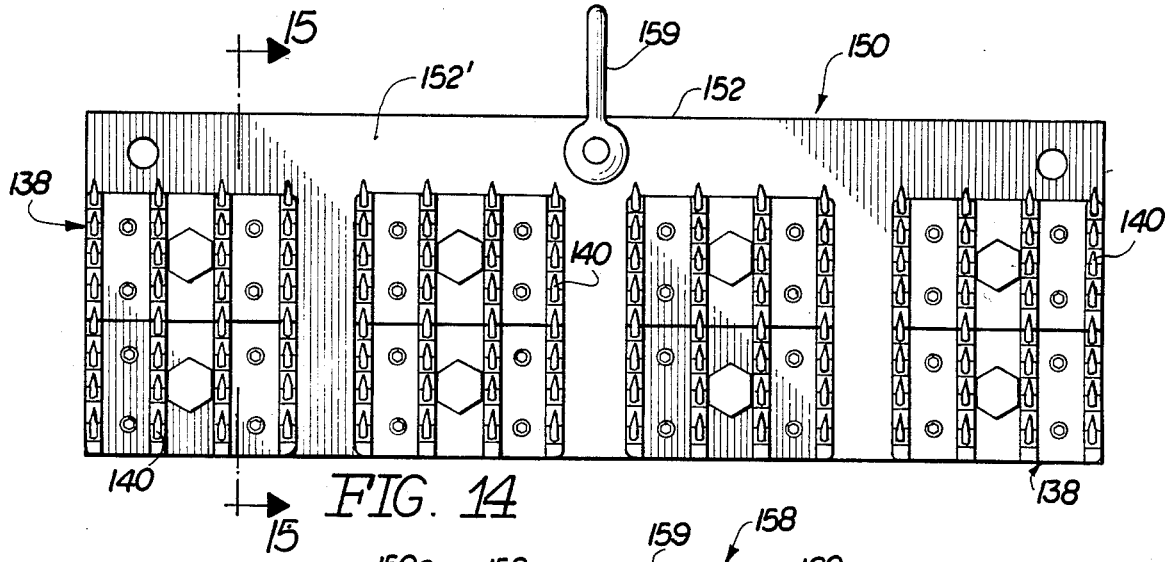
FIG. 14
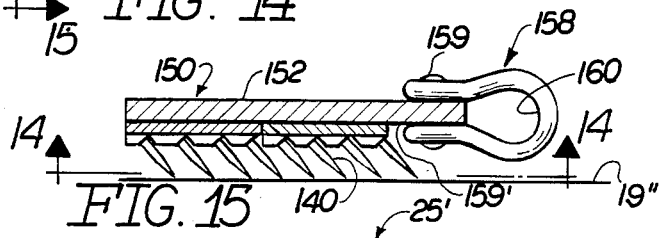
FIG. 15
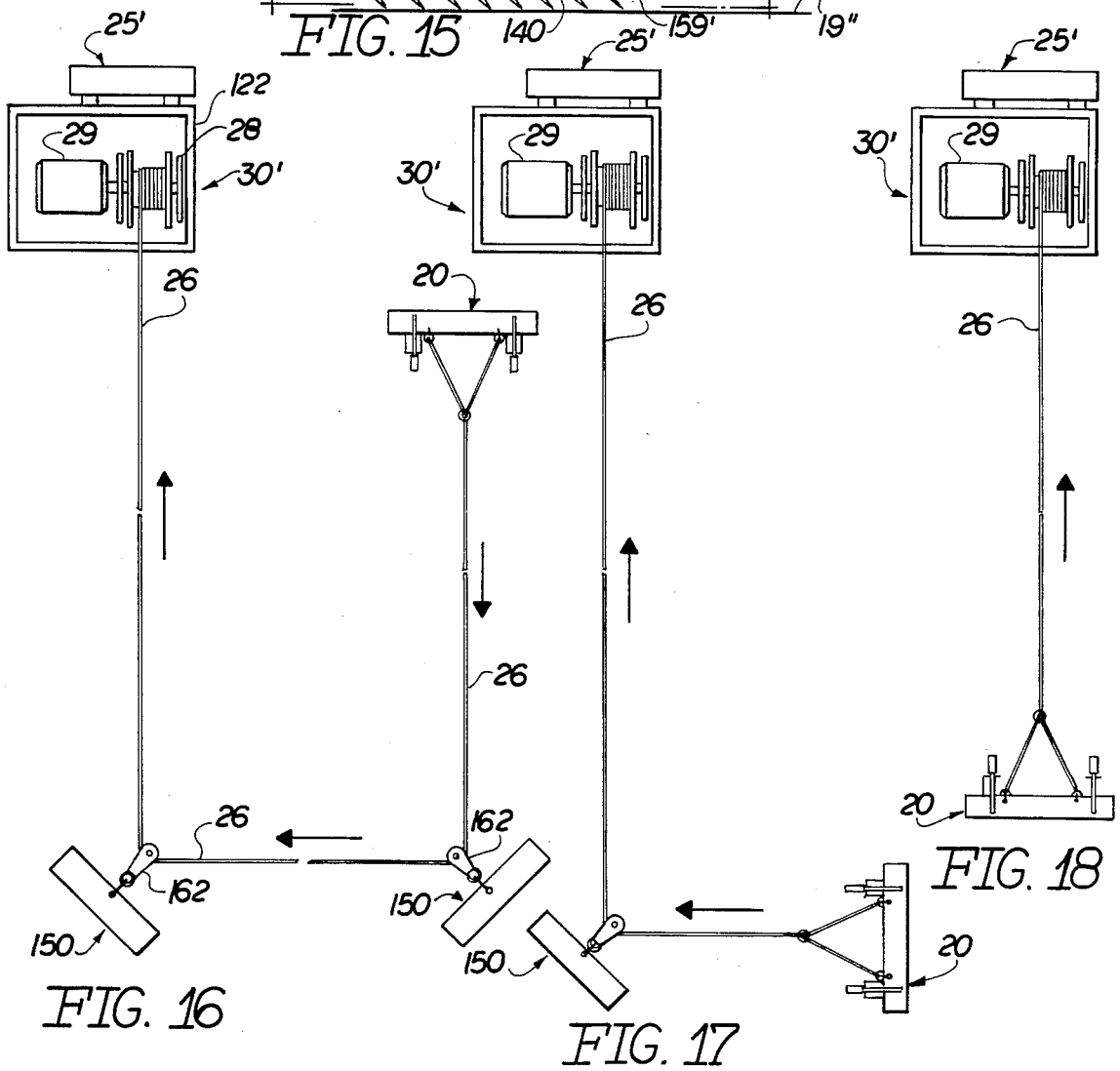
FIG. 16
FIG. 17
FIG. 18

STRIPPER ASSEMBLY FOR REMOVING CARPET

BACKGROUND OF THE INVENTION

This is a continuation-in-part application of copending patent application Ser. No. 505,298 filed on June 17, 1983, now U.S. Pat. No. 4,533,118.

FIELD OF THE INVENTION:

This invention relates to a structural assembly designed to remove carpet from a floor or like surface wherein the carpet is of the type adhered or affixed directly to the floor surface by adhesive or like means.

DESCRIPTION OF THE PRIOR ART:

In large industrial and commercial complexes, where carpet is used as the primary floor covering over generally very large floor areas, it is common practice to adhere or affix the undersurface of the carpet directly to the exposed surface of the floor being covered. This is usually done by glue, adhesive or like material distributed substantially over the entire surface to be covered. This type of installation is considered necessary in high traffic areas.

While the above type installation is effective for maintaining carpet for long periods of time, it has been realized that the removal of this directly adhered carpet from the flooring surface, once it is worn or needs replacement, is extremely difficult. The problem in removing such adhered carpet comes from separating the directly adhered undersurface of the carpet from the flooring. Prior art attempts to accomplish such removal are still extremely time-consuming and manually very difficult. In removing adhesively secured carpets from flooring surfaces, the prior art has primarily relied on a machine designed to remove a rubber back carpet normally secured to the flooring surface by a multi-purpose adhesive which exhibited a bonding or holding strength much less than the extremely strong adhesive currently used to secure jute back carpets to flooring surfaces. Utilizing such a machine the more recently applied jute back carpet or other glued carpeting other than rubber back or cushion back carpet can only be removed in strips approximately 4 inches to 1 foot in width with the operators of such machine and any helpers exerting a maximum physical effort. Such prior art machine may generally be described as an upright scraping machine with a scraping blade located on the front end thereof.

In large installations such as hospitals, retail stores, administrative offices, and the like, downtime of relatively large areas of floor space required when using prior art machines of the type above becomes extremely costly. Further, the noise level associated with such prior art stripper machines may be considered equivalent to a jack hammer and such noise levels are not compatible with commercial spaces having a number of independent commercial occupants.

Accordingly, problems arise in finding laborers willing to perform such difficult tasks. Therefore, it is readily seen that problems existing in the removal of a great deal of directly adhered carpet from a flooring surface, utilizing prior art techniques, is expensive, time-consuming, extremely difficult and presents a serious problem in the industry. The above noted type of prior art machine is certainly operable for its intended use but does not overcome many disadvantages associated with the removal of such securely held carpet as set forth above.

Accordingly, there is a need in the industry for a device which will cause the efficient and relatively easy removal or stripping of such carpet from floor surfaces to which they are directly adhered. Ideally, such an assembly should require a minimal amount of additional workers and preferably carpet portions can be stripped from flooring surfaces in a working period which is much less than when utilizing prior art methods of removal.

SUMMARY OF THE INVENTION

The present invention is directed towards a stripper assembly of the type primarily designed to remove or strip carpet from a flooring surface to which it is directly adhered. Fixing the carpet to the floor surface is currently accomplished by strong, commercial grade glue or adhesives. Such adhesive material is specifically designed to maintain carpets in a fixed, covered position over large surface areas of flooring for extended periods and during adverse or heavy traffic conditions. Therefore, the subject stripper assembly is designed to easily and efficiently remove or strip such carpeting in a manner which overcomes problems previously existing in the prior art.

The stripper assembly of the present invention comprises a gripping means in the form of a gripping jaw assembly having pivotally connected jaw elements movably positioned between an opened and a closed position. Grasping means are mounted on the interior surface of the cooperating jaw elements and are specifically structured to firmly grasp and/or penetrate a portion of the carpet to be stripped. Locking means are affixed to the jaw elements such that the jaw assembly can be locked or maintained in a closed position wherein the carpet to be stripped is securely grasped therebetween.

A driving means, preferably in the form of a motor driven winch is interconnected to the gripping jaw assembly by a cable. The cable is secured at one end to the winch and wound about the winch drum. The opposite end is secured to the rear portion of the gripping jaw assembly. Upon activation of the winch motor, rotation of the drum causes the interconnecting cable to be wound thereabout applying sufficient force to the gripping jaw assembly and the carpet portion maintained therebetween. The carpet is thereby removed or stripped from the flooring surface.

The stripper assembly of the present invention further comprises an anchor means attached to the driving means in a manner which maintains or secures the driving means in a predetermined location and thereby provides resistance to the pulling force required to remove the carpet from the floor.

In a preferred embodiment of the present invention, an anchor means is movably, and preferably pivotally connected to a supporting plate of the driving means. The anchor means comprises a base plate pivotally or rotatably positioned to a substantially outboard location relative to the driving means and into secured engagement with an anchoring carpet portion. The base plate includes a plurality of teeth assemblies each of which has formed thereon a plurality of downwardly extending angularly oriented teeth. At least some of these teeth assemblies are removably attached to the undersurface of the base plate so as to vary the number of penetrating teeth mounted on the base plate and brought into penetrating engagement with the anchoring portion of the carpet generally located adjacent to the supporting plate or portion of the driving means. The actual number of teeth utilized to securely engage the base plate of the anchor means to the anchoring carpet portion depends on the structural characteristics of the anchoring carpet portion wherein more teeth may be utilized if the carpet is old, of relatively thin construction or does not otherwise provide adequate resistance and anchoring of the driving means relative to the pulling force exerted on the gripping means and secured carpet portion attached thereto.

A positioning means in the form of at least one and preferably a plurality of guide fingers are mounted to extend outwardly and downwardly from the undersurface of the base plate of the anchor means into engageable relation with the anchoring carpet portion. The guide fingers are capable of being adjustably positioned relative to the base plate along their length so as to extend outwardly from the undersurface thereof at varying distances. The primary purpose of such guide fingers is to prevent skewing or severe angular orientation between the base plate of the anchor means and the anchoring carpet portion. The guide fingers may be movably positioned along their length to extend outwardly at different distances from the undersurface of the base plate. The base plate can therefore be adapted for secure penetrating engagement with anchoring carpet portions located at varying heights relative to the supporting plate or base of the driving means.

The invention further comprises the provision of supplementary anchoring means including at least one and preferably a plurality of supplementary anchor assemblies. The supplementary anchor assemblies include a plurality of teeth elements, at least some of which are removably secured thereto, and which are positioned for removable, penetrating engagement with a carpet portion. The supplementary anchor assemblies are positioned in initially spaced relation from both the driving means and the gripping means and in spaced relation to one another when more than one supplementary anchor assembly is utilized. A primary purpose of such supplementary anchor assemblies is to allow stripping of adhered carpet portions secured to the gripping means in varying direction rather than merely directly towards the driving assembly as is the case when no supplementary anchor assemblies are utilized. Therefore, the use of a plurality of such anchor assemblies allows stripping of carpet portions from different locations of the room and the exertion of pull on the gripping means and secured carpet portions from different directions without the constant or continuous relocation of the driving means. Further structural features include the pivotal movement of the driving means relative to its maintained and anchored position in order to compensate for the exact angle at which pulling force is exerted on the carpet portion being stripped.

BRIEF DESCRIPTION OF THE DRAWINGS:

For a fuller understanding of the nature of the present invention, reference should be had to the following detailed description taken in connection with the accompanying drawings, in which:

FIG. 14 is a bottom view of the undersurface of a supplementary anchor assembly of the present invention as shown along line 14—14 of FIG. 15.

FIG. 15 is a detailed view in partial section along line 15—15 of FIG. 14.

FIG. 16 is a schematic representation of the stripper assembly of the present invention incorporating the use of a plurality of supplementary anchor assemblies.

FIG. 17 is a schematic representation of the stripper assembly of the present invention incorporating the use of a single supplementary anchor assembly.

FIG. 18 is a schematic representation of the stripper assembly of the present invention incorporating the use of the preferred anchor structure connected to the driving assembly of the present invention and not utilizing a supplementary anchor assembly.

Similar reference characters refer to similar parts throughout the several views of the drawings.

DETAILED DESCRIPTION OF THE PREFERRED EMBODIMENT

Figure 1:
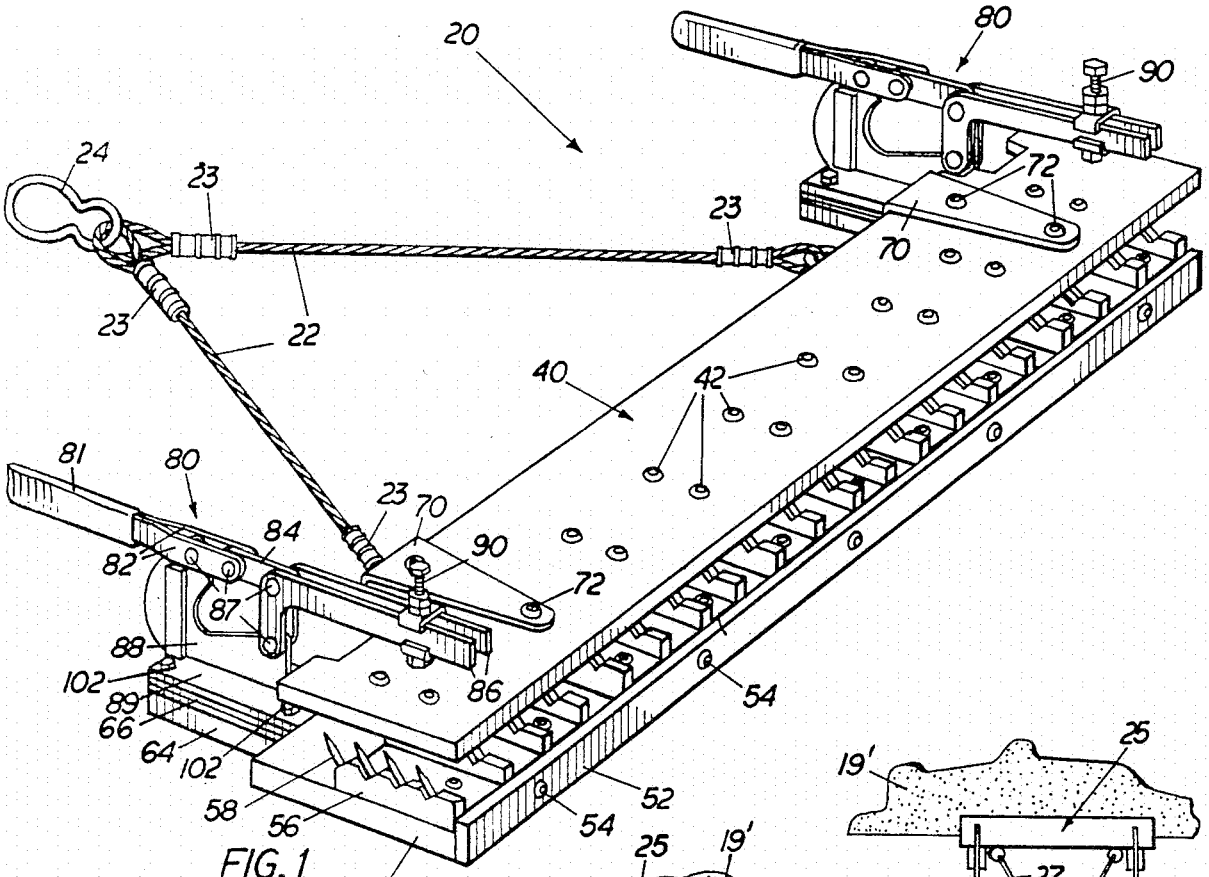
FIG. 1 is an isometric view of the gripping jaw assembly of the present invention.
Figure 2:
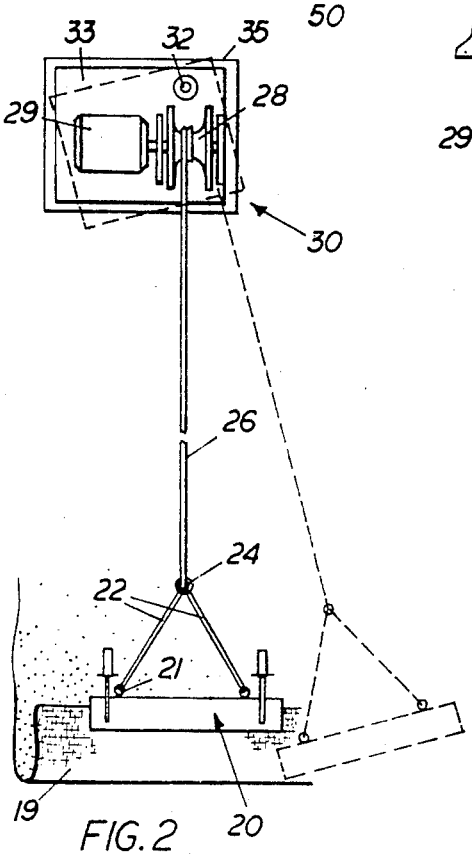
FIG. 2 is a top plan view of the driving and gripping portions of the present assembly with slight reorientation of the assembly shown in broken lines.
Figure 3:
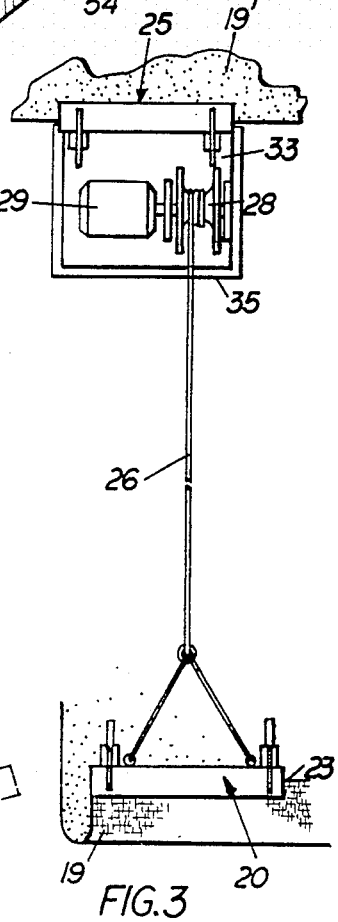
FIG. 3 is a top plan view of the assembly of the present invention showing one embodiment of an anchor structure thereof.
Figure 4:
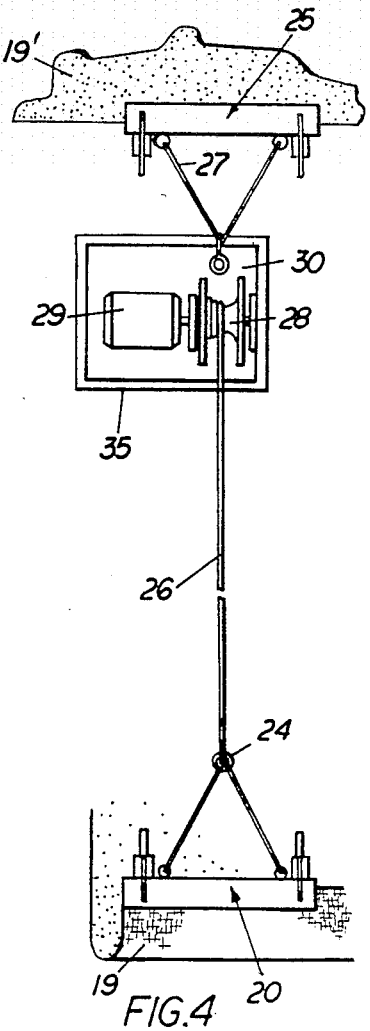
FIG. 4 is a top plan view of the stripper assembly of the present invention showing yet another embodiment of the anchor structure thereof.

As best shown in FIGS. 2, 3 and 4, the stripper assembly of the present invention comprises a gripping means generally indicated as 20 and specifically structured to securely engage an edge portion 23 of a carpet to be removed or stripped from a flooring surface. This gripping means 20 is attached by an interconnecting means 26 in the form of a cable to a driving means generally indicated as 30. In the preferred embodiment, this driving means comprises a winch assembly including a winch drum 28 rotatably driven by an electric motor or the like upon activation. The winch assembly is securely attached to a support platform 33 which in turn is pivotally mounted on an anchor platform 35. The anchor platform is structured to rest on the upper surface of the carpet being stripped or immediately adjacent thereto.

Anchor means generally indicated as 25 is attached to the anchor platform 35 either directly thereto as shown in FIG. 3 or otherwise connected as shown in FIG. 4. The anchor means 25 may be in the form of an anchor jaw assembly wherein the jaw structure of the jaw assembly duplicates the gripping jaw assembly defining or comprising a major portion of the gripping means 20. However, a preferred embodiment of the present invention includes an anchor means as best disclosed in FIGS. 11 through 13 which will be described in greater detail hereinafter.

Figure 5:
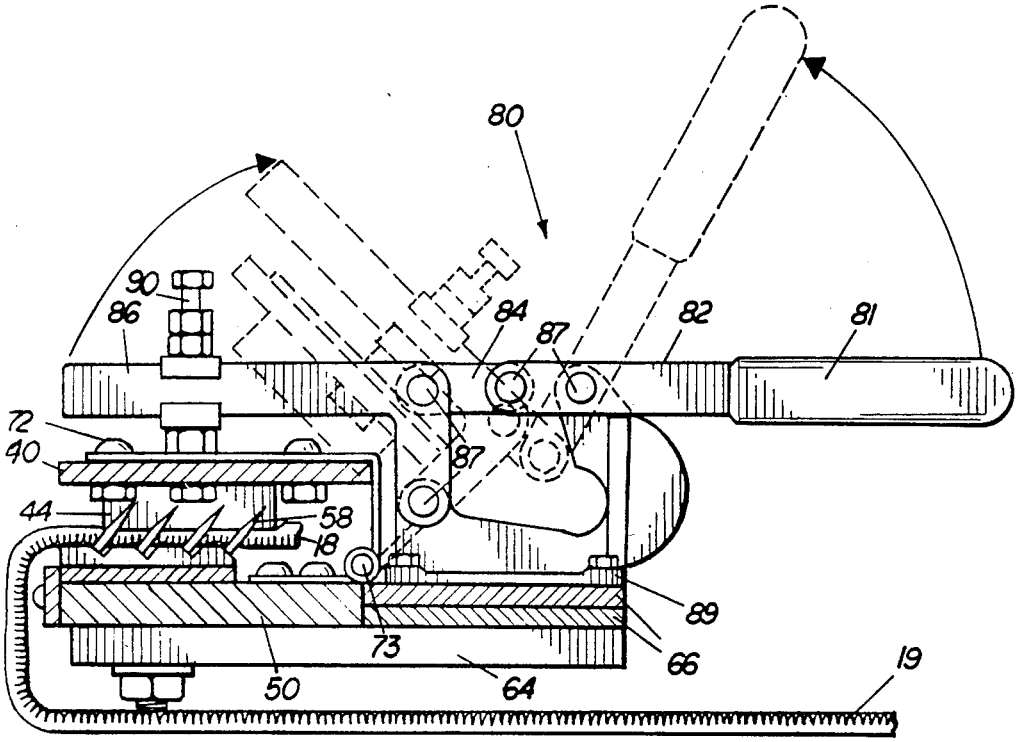
FIG. 5 is a side elevational view of the gripping assembly wherein the structure is represented in its open position in broken lines along 5—5 of FIG. 6.
Figure 6:
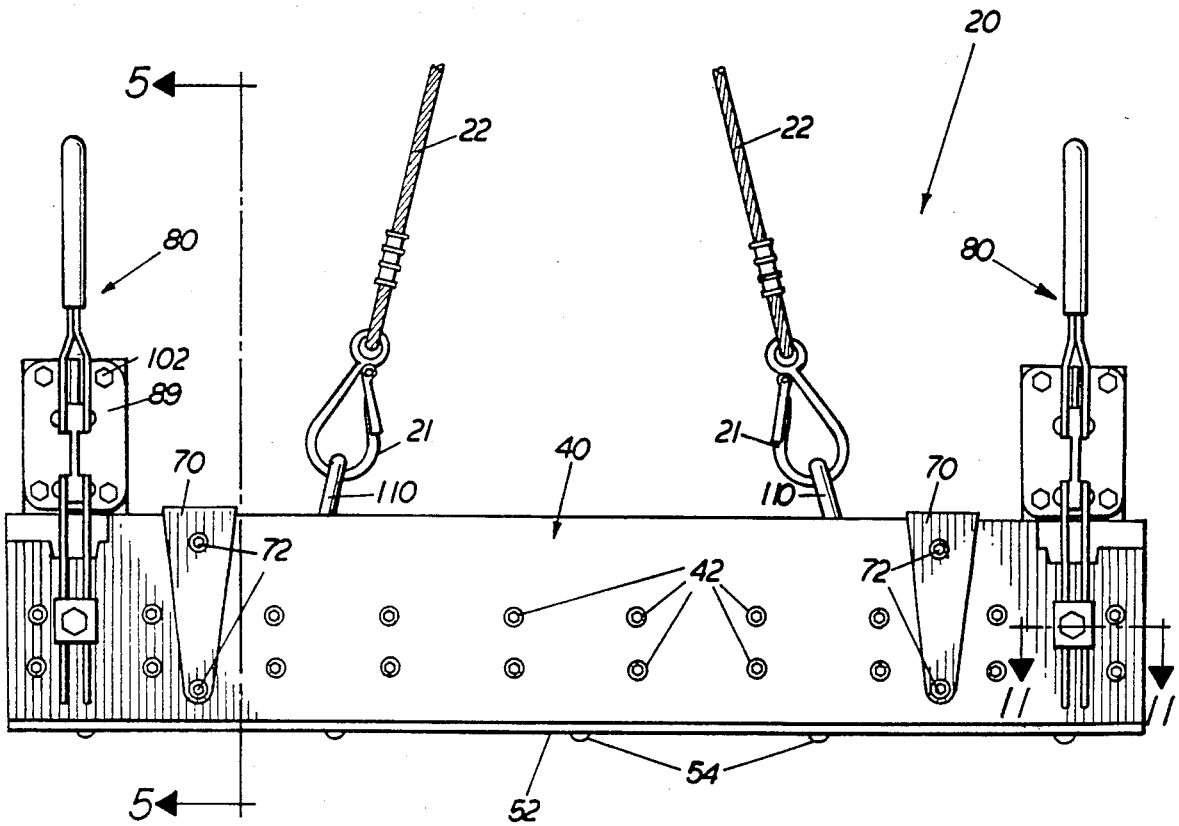
FIG. 6 is a top plan view of the gripping structure of the present invention.
Figure 7:
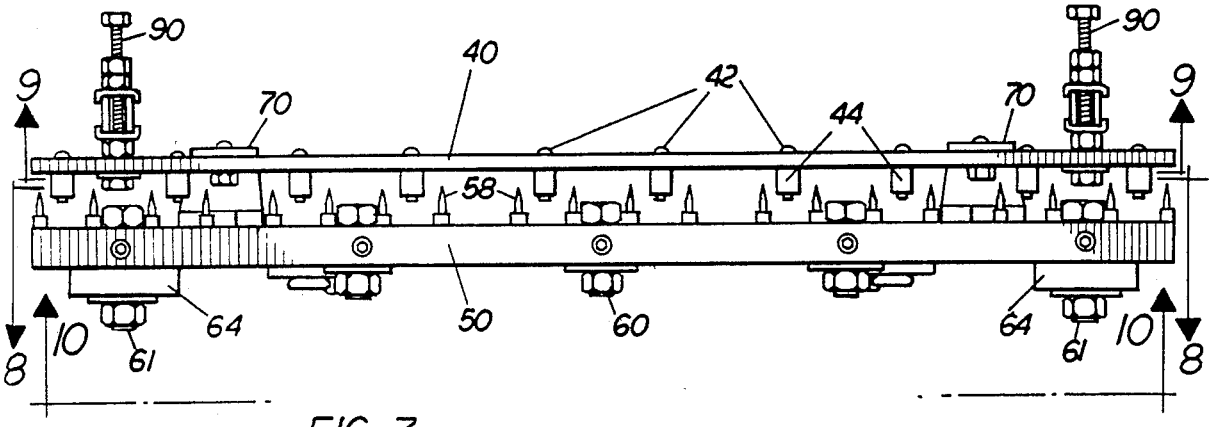
FIG. 7 is a front view of the embodiment of FIG. 6.
Figure 8:
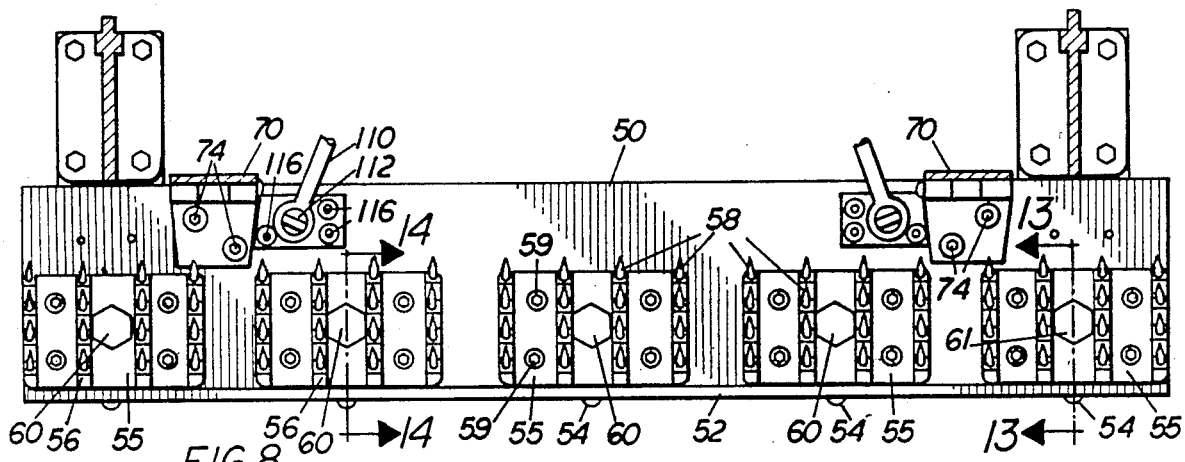
FIG. 8 is a top view along line 8—8 of FIG. 7 showing the structural details of the grasping structure of the present invention.
Figure 9:
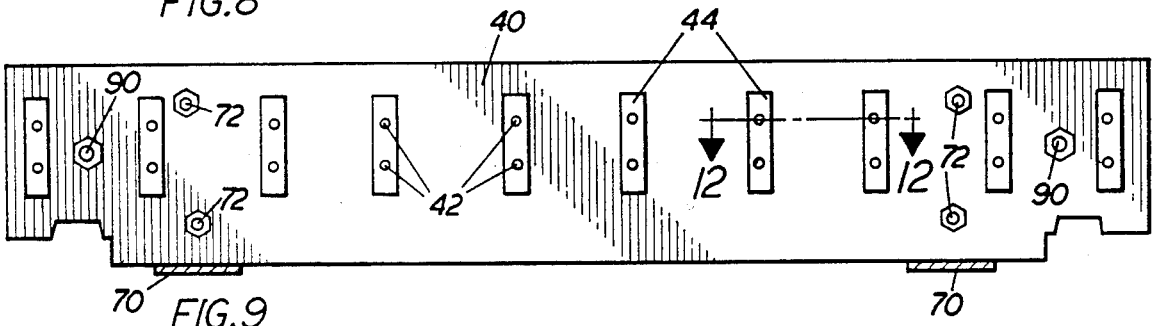
FIG. 9 is a bottom view taken along line 9—9 of FIG. 7 showing structural details of the grasping structure of the present invention.

With regard to FIGS. 1, 2, and 5 through 10, the jaw assembly pictured therein will be described with reference to its function as the gripping jaw assembly. The gripping jaw assembly comprises an upper jaw element 40 and a lower jaw element 50 disposed in cooperative relation to one another and being positioned between an opened and closed position by operation of a locking means generally indicated as 80. With reference to FIG. 5, the closed position is shown in solid lines (also see FIG. 1) and the open position is represented in broken lines. The lower jaw element 50 is secured (FIG. 5) to a mounting platform 64. Similarly, the base 66 of the locking means 80 is secured as at 89 to the rear of this platform 64. The locking means includes a handle portion 81 attached to arm 82 and a positioning portion 86 attached to the upper jaw element 40 by virtue of a screw type clamp connector 90 (see FIGS. 5–7). Both the arm 82 and the positioning portion 86 pivot relative to one another about pivot points 87. Accordingly, link member 84 interconnects the positioning arm 86 to the remaining pivot points 87 through the handle arm 82. Manipulation of handle 81 causes pivotal movement of portions 86 relative to arm 82 and the movement of the upper jaw element 40 relative to the lower jaw element 50 between an open and closed position.

It is therefore seen when the gripping jaw assembly 20 is in its closed position, it securely engages an appropriate edge or end 18 of carpet portion 19 to be stripped from a floor to which it is adhered. Relative movement of the upper jaw element 40 to the lower jaw element 50 occurs about a pivot pin 73 (see FIG. 5). A hinge plate 70 is secured to the upper surface of jaw element 40 by connector element 72 and serves to pivot about the pivot pin 73.

With reference to FIGS. 5 and 7 through 10, the carpet edge 18 is secured between the closed jaw elements 40 and 50 through the provision of a plurality of teeth elements 58 arranged in clusters 55 in elongated rows 56. These clusters 55 are secured to the interior surface of jaw element 50 by connector means 59 and a primary bolt 60 extending through the jaw element 50 (See FIGS. 7 and 8). The plurality of teeth 58 and their individual clusters are arranged in spaced relation to one another a predetermined distance so as to adequately grip the entire length of the carpet edge 18 disposed between the jaw elements 40 and 50. To aid in such gripping procedure, a plurality of positioning blocks 44 are secured to the interior surface of jaw element 40 by a plurality of connectors 42. It should be noted that each of the blocks 44 is disposed between individual rows 56 of teeth 58 so as to force carpet portions down therebetween thereby insuring the penetration of the teeth 58 entirely through the backing and the carpet end 18 per se.

Figure 10:
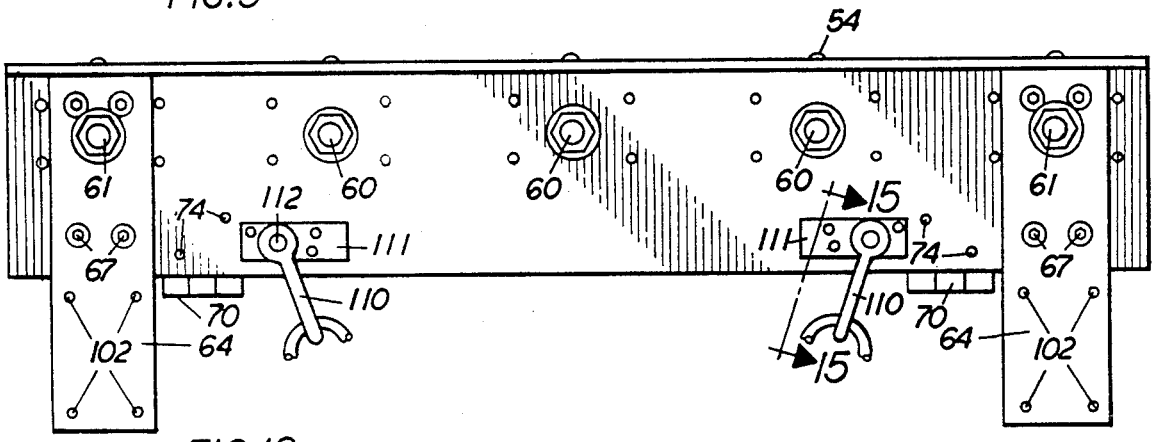
FIG. 10 is a bottom view along line 10—10 of FIG. 7.

With reference to FIG. 10, the undersurface of the jaw element 50 is shown wherein support platform 64 is secured thereto by primary bolt 61 and individual connectors 67. Similarly, connectors 102 serve to secure the support platform 64 to the base 89 of the locking means generally indicated as 80 and described above.

In order to exert the proper pulling force on the carpet portion to be stripped, each of the connecting links 110 is secured to the jaw element 50 by a through bolt 112 about which the connecting link 110 may pivot. Washer elements 111 are provided as shown. To each of the connecting links 110 is connected an attachment cable 22 having opposite ends including a snap hook 21 for engagement of the connecting hooks 110. The attachment cable 22 in turn is secured to an interconnecting means in the form of interconnecting cable 26. The distal end of interconnecting cable 26 is attached as at yoke link 24 wherein its opposite end is attached about the winch drum 28 of the driving means generally indicated as 30. Accordingly, upon activation of the winch motor 29, the interconnecting cable 26 will be forced to reel about the drum 28 thereby exerting a pulling force on the gripping means or the gripping jaw assembly 20. In order to maintain such required pulling force, an anchor means 25 is secured to the anchor plate 35 in order to maintain the driving means or winch assembly in its desired and intended location.

Figure 11:
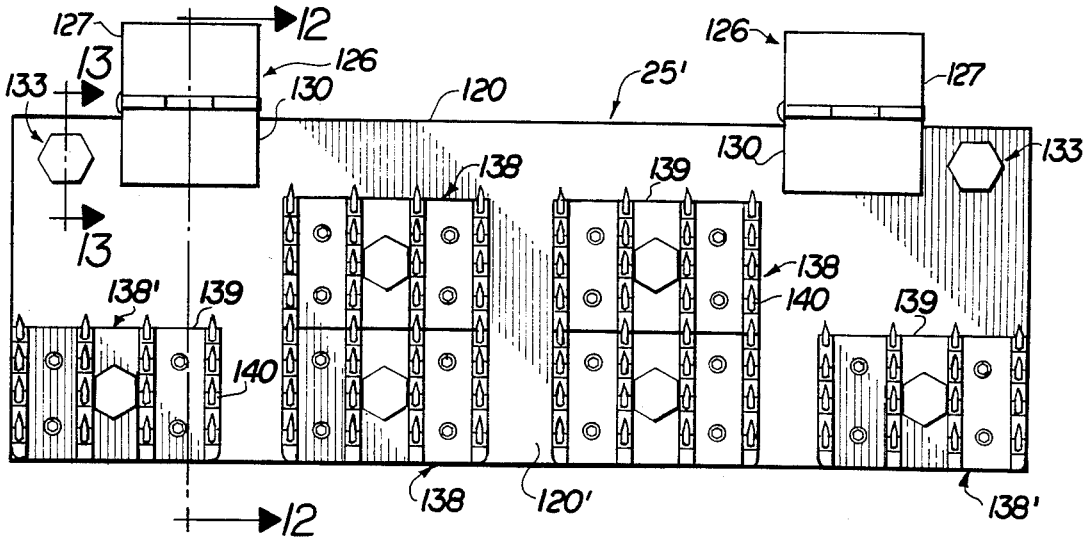
FIG. 11 is a bottom view of the undersurface of a preferred embodiment of the anchor structure of the present invention.
Figure 12:
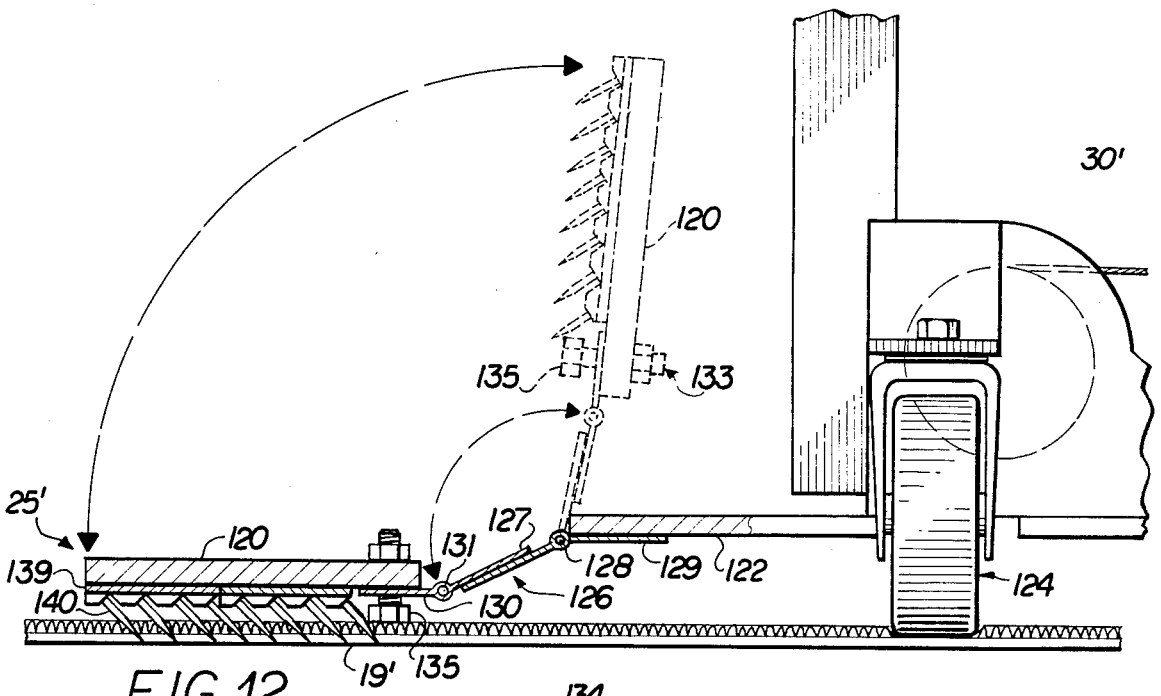
FIG. 12 is a sectional view along line 12—12 of FIG. 11 and further showing a portably mounted driving assembly in partial cutaway connected to the preferred anchor structure.
Figure 13:
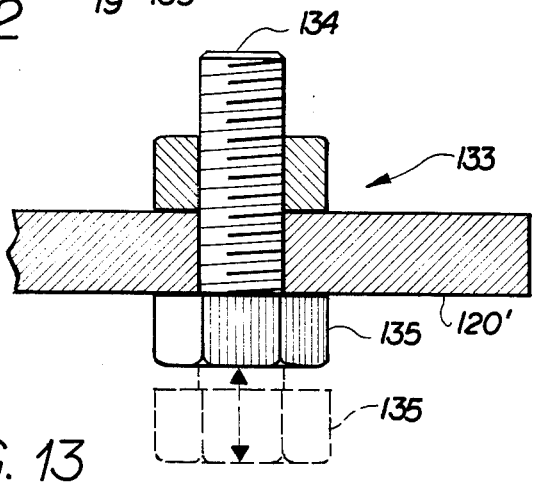
FIG. 13 is a sectional view along line 13—13 of FIG. 11 and shows structural details of a positioning and guide element associated with the anchor structure of the embodiment of FIGS. 11 and 12.

While the anchor means 25 may comprise a substantially duplicate construction of the gripping jaw assembly, other anchor structures, such as in the preferred embodiment of FIGS. 11–13, can be utilized. Accordingly, the anchor means 25 may be defined at least in part by an anchor jaw assembly having the same structural features as the gripping jaw assembly. Such anchor jaw assembly may be attached fixedly to the anchor plate 35 and thereby grip an adjacently positioned carpet portion 19' or otherwise be attached by a connecting cable 27 as shown in FIG. 4.

An important structural feature of the embodiment of FIGS. 2 and 4 of the driving means includes the pivotal or rotatable connection of the support platform 33 to the anchor platform 35. This is accomplished by virtue of a pivot connection 32 located on the opposite side of the gripping jaw assembly or gripping means 20 relative to the winch drum 28. Also, it is preferred that this pivot be substantially aligned with the center of the winch drum and, as much as possible, in alignment with the direction of force or in alignment with the interconnecting cable 26 since most of the stress will be placed directly along this alignment.

It is also important to note that the direction of force applied against the carpet being removed is generally in alignment therewith and the secured carpet portion is maintained sufficiently low enough to accomplish maximum efficiency when the carpet is stripped from the floor. Therefore, the winch drum 28 is positioned in cooperation with the interconnecting cable 26 to exert a pulling force substantially in a line which is substantially parallel to the surface of the carpet being stripped.

As best shown in FIGS. 11, 12 and 13, a preferred embodiment of the anchor means generally indicated as 25' comprises a base means in the form of a base plate 120 pivotally or generally rotatably connected to a supporting base 122 of the driving means generally indicated as 30'.

By way of explanation, the embodiment of FIGS. 11 through 18 differ, at least in part, from the embodiments of FIGS. 1 through 11 in that the driving means 30' includes a single supporting base 122 and preferably eliminates the need for a combined support platform 33 and mounting platform 35 (see FIG. 2). This is due in part to the fact that wheel means 124 are secured to the support base 122 of the driving means 30' so as to allow its efficient movement over any given surface and also to permit at least a minimal adjusting movement or repositioning of the driving means 30' and support base 122 relative to the anchor means 25' and the anchoring carpet portion 19' to which it is secured.

Again with reference to FIGS. 11 and 12, the anchor means 25' is pivotally connected adjacent a peripheral portion of the support base 122 so as to be extendable outwardly therefrom into penetrating relation with the anchoring carpet portion 19'. However, and as will be explained in greater detail hereinafter, the anchoring means 25' may readily be removed from its anchoring position in penetrating, secured relation to anchoring carpet portion 19' and rotated upwardly in its stored position as represented in broken lines in FIG. 12 for transporting of the driving means from one location to another.

Pivotal interconnection between the anchor means 25' and the driving means 30' is accomplished by a hinge means generally indicated as 126. This hinge means serves to act as a double acting hinge in that the interconnecting link 127 is pivotally secured to the undersurface of support base 122 about pivot pin 128 by the hinge leaf 129. Similarly, hinge leaf 130 is secured to the undersurface of the base plate 120 and serves to pivot about pivot pin 131 relative to the connecting link 127. By virtue of this double action hinge means 126, the base plate 120 may be secured in a substantially level fashion relative to the anchoring carpet portion 19' which it engages. This maintenance of a level engagement may be accomplished regardless of the height of the anchoring carpet portion 19' since the double action hinge means 126 is capable of positioning the base plate 120 in substantially level relation to anchoring carpet portions disposed at varying heights.

Another structural feature of the present invention comprises the existence of a positioning means generally indicated as 133. The positioning means 133 comprises at least one and preferably a plurality of guide fingers 134 having a head portion 135 disposable to extend outwardly from the undersurface 120' of the base plate 120 and into engageable relation with the exposed surface of the anchoring carpet portion 19' as best shown in FIG. 12. Each of the guide fingers 134 may be adjustably positioned to travel along its length as indicated by the directional arrow in FIG. 13. This longitudinal adjustment is to vary the outward extension of the head 135 from the undersurface 120' in order to provide adequate positioning support of the undersurface 120' and thereby reduce the tendency of the base plate 120 to skew or become angularly oriented to an extreme degree when a pulling force is exerted upon the anchoring carpet portion 19', such as when the driving means is activated.

The preferred embodiment of the anchor means 25' further includes a plurality of teeth assemblies generally indicated as 138. Each teeth assembly includes a supporting pad 139 having a plurality of downwardly extending and angularly oriented teeth elements 140 mounted thereon.

At least some of the teeth assemblies such as indicated by 138', and preferably all of the teeth assemblies, may be removably secured to the undersurface 120' of the base plate 120 such that the actual number of teeth elements 140 which penetrate the anchoring carpet portion 19' may be varied. The number of teeth required to provide secure anchoring resistance to the driving means and maintain it in the desired relatively fixed position is dependent upon the specific structural characteristics of the anchoring carpet portion 19'. These characteristics determine the overall strength in resisting the force being exerted thereon by the anchor means 25' such as when the driving means is activated.

With reference to FIGS. 14 through 18, another embodiment of the present invention comprises a supplemental anchor means comprising at least one and preferably a plurality of supplemental anchor assemblies generally indicated as 150. As shown in FIG. 14, a plurality of teeth means may comprise similarly structured teeth assemblies 138 as mounted on the undersurface 120' of base plate 120 of the anchor means 25'. Therefore, certain ones or all of the teeth assemblies 138 may be removably secured to the undersurface 152' of the supplemental anchor assemblies such that individual teeth 140 are disposed in penetrating relation to a carpet portion 19''. Further, means such as hook member 158 is secured to a leading edge of the mounting plate 152 and is pivotally attached to extend outwardly therefrom about a pivot pin 159 so as to define a substantially closed loop 160 through which interconnecting cable 26 may pass. It is readily seen therefore and with specific reference to FIGS. 16 and 17 that the interconnecting cable 26 is movably interconnected to the supplementary anchor assemblies 150 in order to at least partially define the path of travel of the interconnecting cable 26 as the driving means 30' is activated and further as the gripping means 20 with secured carpet portion attached thereto is pulled towards the driving means 30'. In order to facilitate movement of interconnecting cable 26 along the referred to path of travel, at least partially defined by the supplementary anchor assemblies 150, a pulley assembly 160 may be movably interconnected to the hook element 158.

The directional arrows indicated in FIGS. 17 and 18 show the aforementioned defined and intended path of travel of the interconnecting cable 26 upon activation of the driving means 30'. It can readily be seen therefor that the carpet may be stripped or removed from its floor surface in varying directions and from various portions of the floor surface without successively relocating the drive means 30'.

Further with regard to FIG. 18, it should be obvious that the preferred anchor means 25' can be utilized in combination with the driving means 30' without the incorporation of any of the supplementary anchoring assemblies 150. The secured carpet portion attached to the gripping means 50 is thereby removed in a straight line direction indicated by the appropriately positioned directional arrows.

What is claimed is:

1. A stripper assembly primarily designed to remove carpeting of the type directly adhered to a floor or like surface, said stripper assembly comprising:

(a) gripping means structured for secure attachment to a portion of a carpet being stripped and a driving means interconnected to said gripping means, (b) interconnecting means comprising a cable attached substantially at one end thereof to said gripping means and mounted at an opposite end thereof to said driving means, said driving means including a support base and a power driven winch mounted on said support base, said winch connected to driving and pulling relation to said cable, said winch and said cable disposed and structured to exert a pulling force on said gripping means upon activation of said driving means, (c) anchor means movably connected to said driving means and adjustably positioned relative to an anchoring carpet portion adjacent said driving means, said anchor means structured for secured positioning of said driving means relative to the anchoring carpet portion, (d) said anchor means comprising a base means and teeth means attached to said base means and extending outwardly from an undersurface thereof into penetrating relation to the anchoring carpet portion, and (e) said base means movably attached to said support base and selectively positionable between an anchoring position and a stored position, said anchoring position defined by an outwardly extending disposition of said base means relative to said support base and penetrating engagement of said teeth means with the anchoring carpet portion; said stored position defined by orientation of said base means in substantially totally supported relation on said support base.

2. A stripper assembly as in claim 1 wherein said teeth means comprises a plurality of teeth assemblies each including a plurality of teeth elements, at least some of said teeth assemblies removably secured to said base means, whereby the number of teeth elements securing said anchoring means to the anchoring carpet portion can be varied dependent upon the structural characteristics of the anchoring carpet portion.

3. A stripper assembly as in claim 2 wherein each of said plurality of teeth assemblies include a support pad secured to an undersurface of said base means and at least some of which are removably secured thereto, said plurality of teeth elements mounted on said pads to extend outwardly thereform into penetrating relation with the anchoring carpet portion.

4. A stripper assembly as in claim 2 wherein at least some of said plurality of teeth elements are angularly oriented towards said gripping means.

5. A stripper assembly as in claim 1, wherein said base means comprises a base plate, said base plate including a positioning means movably attached thereto and extending outwardly from said base plate into engageable relation with the anchoring carpet portion, said positioning means movable relative to said base plate in a direction substantially transverse to said base plate into engagement with said anchoring carpet portion and selectively positionable to regulate orientation and distance of said base plate relative to said anchoring carpet portion.

6. A stripper assembly as in claim 5 wherein said driving means is disposed between said base plate and said gripping means relative to a path of travel of said interconnecting means, said base plate disposed substantially transverse to a direction of extension of said interconnecting means from said driving means.

7. A stripper assembly as in claim 5 wherein said positioning means comprises a plurality of guide fingers extending outwardly from an undersurface of said base plate into engaging relation with the anchoring portion, said guide fingers adjustably movable along their length relative to said base plate so as to vary the outward extension of said guide fingers from said base plate, whereby the distance between the undersurface of said base plate and the anchoring carpet portion can be regulated.

8. A stripper assembly as in claim 1 wherein said base means comprises a base plate; a hinge means pivotally interconnecting said gripping means to said driving means and secured to a peripheral edge of said base plate and to a correspondingly positioned peripheral edge of said support base, said base plate and teeth means rotatable outwardly from said driving means into said anchoring position and engagement with the anchoring carpet portion.

9. A stripper assembly as in claim 8 further comprising wheel means mounted on said support means and structured to facilitate movement of said driving means over a surface on which it is positioned, said hinge means and said wheel means cooperatively disposed relative to said support base so as to movably anchor said driving means to the anchoring carpet portion, whereby at least a minimal adjusting movement between said support base and the anchoring carpet portion is permitted during activation of said driving means.

10. A stripper assembly as in claim 9 wherein said base plate is pivotally connected to a rear peripheral edge portion of said support base by said hinge means and in a substantially transverse relation to a direction of extension of said cable directed outwardly from said driving means, said base plate positionable outwardly from said rear peripheral edge into secured engagement with the anchoring carpet portion.

11. A stripper assembly as in claim 1 further comprising supplementary anchor means fixedly secured to a carpet portion located in spaced relation from said driving means and between said driving means and said gripping means, said supplementary anchor means disposed along a length of said cable and the latter being movably interconnected to said supplementary anchor means, said supplementary anchor means disposed to define a path of travel of said gripping means and secured carpet portion upon activation of said driving means.

12. A stripper assembly as in claim 11 wherein said supplementary anchor means is structured for removable, penetrating engagement with a carpet portion and initially spaced distance from both said gripping means and said driving means, connecting means secured to said supplementary anchor means and further including means to movably connect said cable to said anchoring means so as to allow travel of said cable along said path of travel.

13. A stripper assembly as in claim 12 wherein said supplementary anchor means comprises at least one anchor assembly including a mounting plate, a plurality of teeth elements secured to said mounting plate, said teeth elements structured and configured for removable penetrating engagement with a carpet portion.

14. A stripper assembly as in claim 13 wherein at least some of said plurality of teeth elements are removably secured to said mounting plate, whereby the number of teeth elements securing said mounting plate to the carpet portion can be varied dependent upon the structural characteristics of the carpet portion.

15. A stripper assembly as in claim 11 wherein said supplementary anchor means comprises a plurality of supplementary anchor assemblies each removably secured to a carpet portion and disposed in spaced relation to one another along said path of travel of said cable and between said gripping means and said driving means, said cable being removably connected to each of said supplementary anchor assemblies.

16. A stripper assembly as in claim 15 wherein each of said supplementary anchor assemblies comprises a mounting plate and a plurality of teeth elements secured thereto, said teeth elements structured and configured for removable penetrating engagement with a carpet portion and means to movably connect said interconnecting means to each of said supplementary anchor assemblies such that said gripping means successively moves to and between said supplementary anchor assemblies and along said path of travel upon activation of said driving means.

17. A stripper assembly as in claim 16 wherein at least some of said plurality of teeth elements are removably secured to said mounting plate, whereby the number of teeth elements securing said mounting plate to the carpet portion can be varied dependent upon the structural characteristics of the carpet portion.

* * * * *